US007461520B2

(12) United States Patent
Iijima et al.

(10) Patent No.: US 7,461,520 B2
(45) Date of Patent: Dec. 9, 2008

(54) GAS LIQUEFACTION PLANT

(75) Inventors: Takayuki Iijima, Yokohama (JP); Shinichi Fukuoka, Yokohama (JP); Naoyuki Takezawa, Yokohama (JP)

(73) Assignee: JGC Corporation, Tokyo (JP)

( * ) Notice: Subject to any disclaimer, the term of this patent is extended or adjusted under 35 U.S.C. 154(b) by 331 days.

(21) Appl. No.: 10/526,104

(22) PCT Filed: Nov. 9, 2004

(86) PCT No.: PCT/JP2004/016921

§ 371 (c)(1),
(2), (4) Date: Feb. 24, 2005

(87) PCT Pub. No.: WO2005/050109

PCT Pub. Date: Jun. 2, 2005

(65) Prior Publication Data

US 2006/0150671 A1 Jul. 13, 2006

(30) Foreign Application Priority Data

Nov. 18, 2003 (JP) ..... 2003-387748

(51) Int. Cl.
*F25J 1/00* (2006.01)

(52) U.S. Cl. ..... 62/611; 62/612

(58) Field of Classification Search ..... 62/612, 62/611

See application file for complete search history.

(56) References Cited

U.S. PATENT DOCUMENTS 4,911,741 A 3/1990 Davis et al.
5,473,900 A 12/1995 Low
5,735,135 A * 4/1998 Katsuki et al. ..... 62/259.1
6,016,665 A * 1/2000 Cole et al. ..... 62/612
6,119,479 A * 9/2000 Roberts et al. ..... 62/612
6,308,531 B1 * 10/2001 Roberts et al. ..... 62/611
6,742,357 B1 * 6/2004 Roberts ..... 62/612

FOREIGN PATENT DOCUMENTS

| | | |
|---|---|---|
| JP | 2-106689 A | 4/1990 |
| JP | 10-170144 A | 6/1998 |
| JP | 2000-180048 A | 6/2000 |
| RU | 2144649 | 1/2000 |
| SU | 1460559 | 2/1989 |

* cited by examiner

*Primary Examiner*—William C Doerrler
(74) *Attorney, Agent, or Firm*—Darby & Darby PC

(57) ABSTRACT

A gas liquefaction plant includes a pre-cooling exchanger which pre-cools a feed gas by means of indirect heat exchange with a first refrigerant; a first refrigerant compressor which compresses the first refrigerant which has been used for refrigerating the feed gas in the pre-cooling exchanger; a cryogenic heat exchanger which refrigerates and liquefies the feed gas which has been pre-cooled by the pre-cooling exchanger by means of indirect heat exchange with a second refrigerant; a second refrigerant compressor which refrigerates the second refrigerant which has been used for cooling and liquefying the feed gas in the cryogenic heat exchanger; and a piping complex which receives piping used in the gas liquefaction plant, wherein the pre-cooling exchanger, the first refrigerant compressor, the cryogenic heat exchanger, and the second refrigerant compressor are installed at one side of the piping complex.

4 Claims, 2 Drawing Sheets

GAS LIQUEFACTION PLANT

TECHNICAL FIELD

The present invention relates to a gas liquefaction plant in which feed gas, such as natural gas, is liquefied to yield liquefied gas, such as liquefied natural gas.

Priority is claimed on Japanese Patent Application No. 2003-387748, filed Nov. 18, 2003, the content of which is incorporated herein by reference.

DESCRIPTION OF THE RELATED ART

Conventionally, gas liquefaction plants in which a natural gas, as a feed gas, is liquefied to obtain a liquefied natural gas have been known, and such a gas liquefaction plant includes: a pre-cooling facility which pre-cools a natural gas and refrigerates a blended refrigerant (MCR) which is used for pre-cooling the natural gas; and a liquefaction facility which liquefies the pre-cooled natural gas and refrigerates the blended refrigerant which is used for liquefying the pre-cooled natural gas (see U.S. Pat. No. 6,119,479, for example).

Such a gas liquefaction plant 21 according to the prior art will be described with reference to FIG. 1.

First, as a pre-treatment for a natural gas, acid gases are removed from the natural gas by an acid gas removal facility 22, and then the natural gas is dehydrated in a dehydrating facility 23 in this prior art.

The natural gas which has been subjected to the above-described pre-treatment is then pre-cooled by a first group of pre-cooling exchangers 24-1. After refrigerating the natural gas to intermediate temperatures between approximately −20° C. and approximately −70° C., heavy components in the natural gas are removed by a heavy component removing facility 26. Upon removing heavy components, heavy gases which have two or more carbon atoms (ethane and components which are heavier than ethane), for example, are removed.

The separated heavy gases having two or more carbon atoms are supplied to a fractionating facility 30 which fractionates these heavy gases. Thereafter, light components having four or fewer carbon atoms are collected, supplied to a cryogenic heat exchanger 27, and then mixed with liquefied natural gas. Heavy components with five or more carbon atoms are obtained as a "condensate," which is a product.

The natural gas from which the heavy components (principally, methane, some ethane, propane, and butane) have been removed is cooled, condensed, and liquefied by the cryogenic heat exchanger 27 using a second refrigerant pre-cooled by a second group of pre-cooling exchangers 24-2, and a liquefied natural gas is obtained.

The pre-cooling in the first group of pre-cooling exchangers 24-1, cooling in the heavy component removing facility 26, and the pre-cooling of the second refrigerant in the second group of pre-cooling exchangers 24-2 are achieved using a first refrigerant compressor 25 which is connected to the pre-cooling exchanger 24-1, the heavy component removing facility 26, and the second group of pre-cooling exchangers 24-2 via refrigerant piping 29, respectively. The first refrigerant compressor 25 compresses and refrigerates the refrigerant which has been used for pre-cooling the natural gas in the first group of pre-cooling exchangers 24-1, and supplies the compressed refrigerant to the first group of pre-cooling exchangers 24-1. The first refrigerant compressor 25 also compresses the refrigerant which has been used for refrigeration in the heavy component removing facility 26, and supplies the compressed refrigerant to the heavy component removing facility 26. Furthermore, the first refrigerant compressor 25 compresses and refrigerates the refrigerant which has been used for pre-cooling the second refrigerant in the second group of pre-cooling exchangers 24-2, and supplies it to the second group of pre-cooling exchangers 24-2.

Furthermore, refrigeration, condensation, and liquefaction of the natural gas in the cryogenic heat exchanger 27 is achieved using a second refrigerant compressor 28. The second refrigerant compressor 28 is connected to the cryogenic heat exchanger 27 via the second group of pre-cooling exchangers 24-2 by means of the refrigerant piping 29. The second refrigerant compressor 28 compresses the second refrigerant which has been used for liquefying the natural gas in the cryogenic heat exchanger 27, and supplies the compressed second refrigerant to the second group of pre-cooling exchangers 24-2.

As shown in FIG. 1, in the gas liquefaction plant 21 according to the prior art, the acid gas removal facility 22, the first group of pre-cooling exchangers 24-1, the heavy component removing facility 26, the second group of pre-cooling exchangers 24-2, and the cryogenic heat exchanger 27 are installed at one side 33 of the piping complex (pipe rack) 31 which receives product line piping 34 used in the gas liquefaction plant 21, whereas the dehydrating facility 23, the fractionating facility 30, the first refrigerant compressor 25, and the second refrigerant compressor 28 are installed at the other side 32 of the pipe rack.

The refrigerant piping 29 which connects the first refrigerant compressor 25 and the second group of pre-cooling exchangers 24-2, and the refrigerant piping 29 which connects the second refrigerant compressor 28 and the cryogenic heat exchanger 27 are required to be installed in the pipe rack 31.

In general, the pipe rack 31 is required to have a high strength so that the pipe rack 31 can withstand the weight of the refrigerant piping 29 since the refrigerant piping 29 has a large diameter (for example, 72 inches), and to have an increased height. That results in a prolonged construction period and increased construction cost.

Moreover, since the higher pipe rack requires more high elevation work, the risk related to the construction increases and safety issues may occur.

Furthermore, heat loss and pressure drop of the refrigerant may increase since the refrigerant piping lines become long.

DISCLOSURE OF THE INVENTION

The present invention addresses the above-mentioned problems, and an object thereof is to provide a gas liquefaction plant which solves the disadvantages of prior-art gas liquefaction plants. With gas liquefaction plant of the present invention, it is possible to reduce the height of a pipe rack, to solve the issue of the strength of the pipe rack, to shorten the design and construction period of the pipe rack so as to reduce the construction cost. In addition, it is possible to reduce high elevation work so that the risk related to the construction is reduced, and to solve the issue of heat loss and pressure drop of a refrigerant.

To achieve the above-described object, the present invention is directed to a gas liquefaction plant including: a pre-cooling exchanger which pre-cools a feed gas by means of indirect heat exchange with a first refrigerant;

a first refrigerant compressor which compresses the first refrigerant which has been used for refrigerating the feed gas in the pre-cooling exchanger;

a cryogenic heat exchanger which refrigerates and liquefies the feed gas which has been pre-cooled by the pre-cooling exchanger by means of indirect heat exchange with a second refrigerant;

a second refrigerant compressor which refrigerates the second refrigerant which has been used for cooling and liquefying the feed gas in the cryogenic heat exchanger; and a piping complex which receives piping used in the gas liquefaction plant, wherein the pre-cooling exchanger, the first refrigerant compressor, the cryogenic heat exchanger, and the second refrigerant compressor are installed at one side of the piping complex.

The second refrigerant which is compressed in the second refrigerant compressor may be pre-cooled using the first refrigerant supplied from the first pre-cooling exchanger, and may be supplied to the cryogenic heat exchanger.

According to this invention, since the pre-cooling exchanger, the first refrigerant compressor, the cryogenic heat exchanger, and the second refrigerant compressor are installed at one side of the piping complex, it is not required to install, in the piping complex, the refrigerant piping which connects the pre-cooling exchanger and the first refrigerant compressor, and the refrigerant piping which connects the cryogenic heat exchanger and the second refrigerant compressor. Thus, it is possible to reduce the height of the piping complex, to solve the issue of the strength of the piping complex, to shorten the design and construction period of the piping complex so as to reduce the construction cost. In addition, it is possible to reduce high elevation work so that the risk related to the construction is reduced.

Furthermore, it is possible to shorten the refrigerant piping which connects the pre-cooling heat exchanger and the first refrigerant compressor, and the refrigerant piping which connects the cryogenic heat exchanger and the second refrigerant compressor. Thus, it is possible to reduce heat loss and pressure drop of a refrigerant.

According to the present invention, the refrigerant piping which connects the pre-cooling heat exchanger and the first refrigerant compressor, and the refrigerant piping which connects the cryogenic heat exchanger and the second refrigerant compressor may be arranged without being installed in the piping complex.

According to this invention, it is possible to reduce the height of the piping complex, to solve the issue of the strength of the piping complex, to shorten the design and construction period of the piping complex so as to reduce the construction cost. In addition, it is possible to reduce high elevation work so that the risk related to the construction is reduced.

In addition, since it is possible to shorten the refrigerant piping which connects the pre-cooling heat exchanger and the first refrigerant compressor, and the refrigerant piping which connects the cryogenic heat exchanger and the second refrigerant compressor, heat loss and pressure drop of the refrigerant can be reduced.

Furthermore, according to the present invention, the pre-cooling exchanger and the first refrigerant compressor may be installed adjacent to each other, and the cryogenic heat exchanger and the second refrigerant compressor may be installed adjacent to each other.

According to this invention, since it is possible to shorten the refrigerant piping which connects the pre-cooling heat exchanger and the first refrigerant compressor, and the refrigerant piping which connects the cryogenic heat exchanger and the second refrigerant compressor, heat loss and pressure drop of the refrigerant can be reduced.

In addition, according to the present invention, a heavy component removing facility which removes a heavy component in the feed gas may be installed between a first heat exchange area defined by the pre-cooling exchanger and the first refrigerant compressor, and the a second heat exchange area defined by the cryogenic heat exchanger and the second refrigerant compressor at one side of the piping complex, and a pre-treatment facility which pre-treats the feed gas before the feed gas is cooled by the pre-heat exchanger, may be installed at the other side of the piping complex.

According to this invention, since the heavy component removing facility is installed between the first heat exchange area and the second heat exchange area, the natural gas being supplied to the heavy component removing facility, and the natural gas exiting from the heavy component removing facility can be pre-cooled effectively. Moreover, since the pre-treatment facility, which pre-treats the feed gas before it is refrigerated by the pre-cooling exchanger, is installed at the other side of the piping complex, it is possible to prevent various facilities from being installed only at one side of the piping complex. Thus, it is possible to reduce the size of the gas liquefaction plant.

BEST MODE FOR CARRYING OUT THE INVENTION

Preferred embodiments of the invention will be described with reference to the drawings. However, it should not be construed that the present invention is limited to those embodiments; rather, components of those embodiments, for example, may be combined if necessary.

Figure 1:
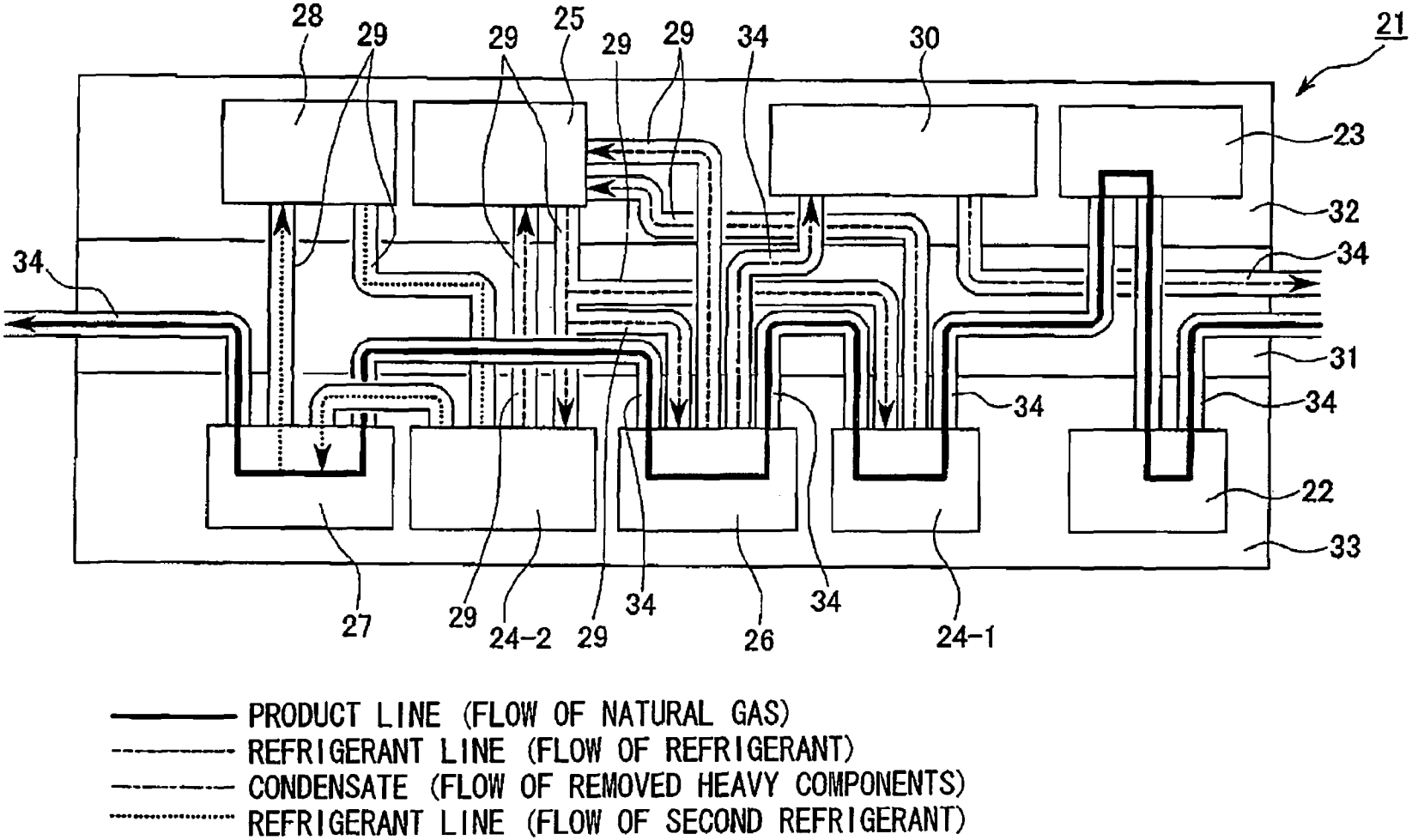
FIG. 1 PRIOR ART
FIG. 1 is a diagram illustrating a gas liquefaction plant according to the prior-art.
Figure 2:
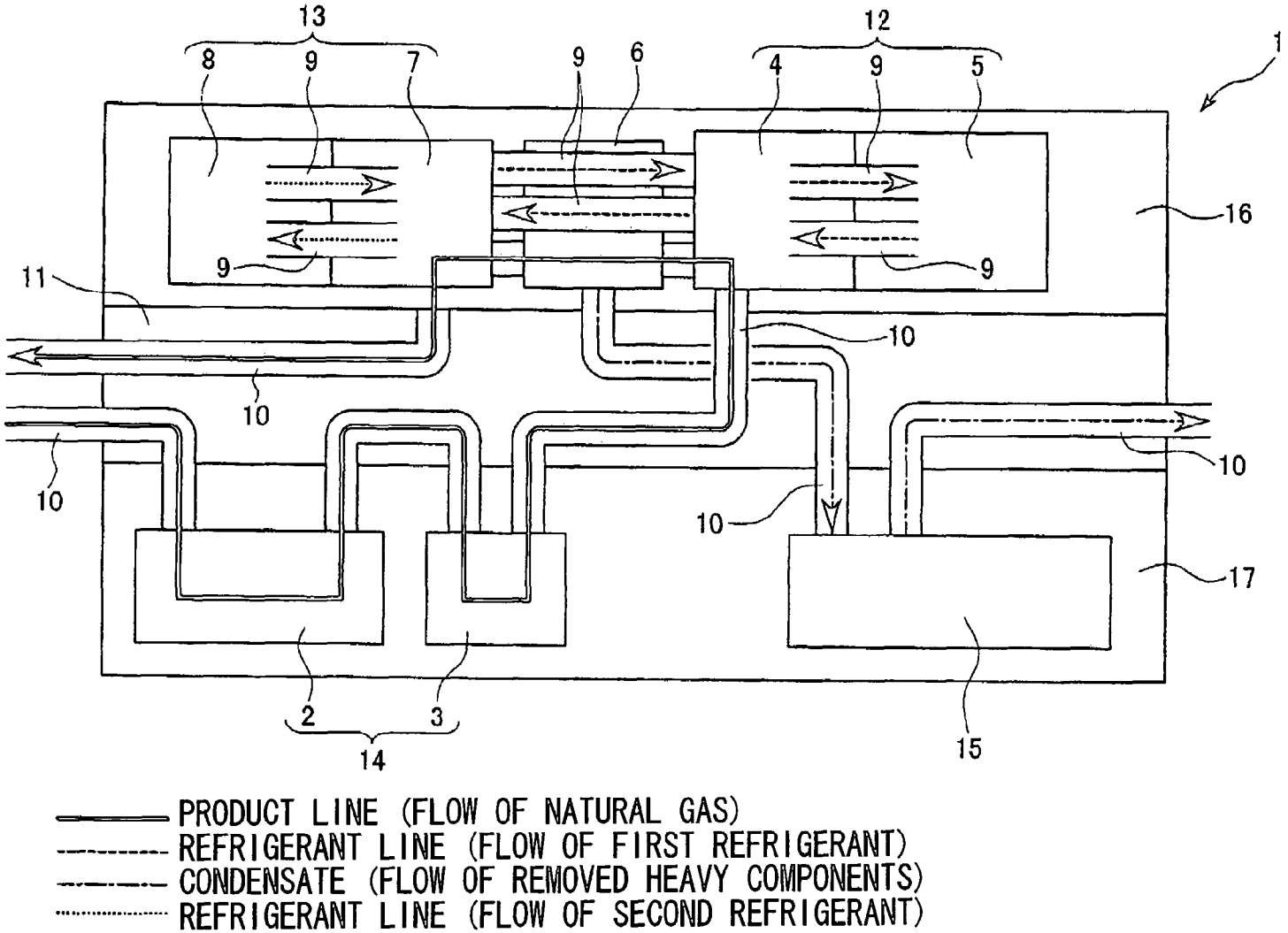
FIG. 2 is a diagram illustrating a gas liquefaction plant according to one embodiment of the present invention.

A gas liquefaction plant 1 according to an embodiment of the present invention will be described with reference to FIG. 2.

Feed gas used in the gas liquefaction plant 1 according to this embodiment of the present invention is natural gas, for example.

First, as a pre-treatment of the natural gas, acid gases are removed from the natural gas by an acid gas removal facility 2, and then the natural gas is dehydrated in a dehydrating facility 3. Upon removal of acid gasses, $CO_2$ and $H_2S$, are removed, for example, and upon dehydration, contaminants, such as mercury or mercury-containing compounds, are also removed.

Next, the pre-treated natural gas is supplied to a pre-cooling exchanger 4, in which the natural gas is pre-cooled to intermediate temperatures between approximately −20° C. and approximately −70° C. It should be noted that the pre-cooling exchanger 4 includes one or more pre-cooling exchangers, and piping which connects between the pre-cooling exchangers are arranged without being installed in a pipe rack. A first refrigerant in the first pre-cooling exchanger includes one or more hydrocarbons selected from the group consisting of methane, ethane, propane, i-butane, butane, and i-pentane, and may contain other components, such as nitrogen. A first refrigerant compressor 5 compresses the vaporized first refrigerant which has been used for refrigerating the natural gas in the pre-cooling exchanger 4, and supplies it to the pre-cooling exchanger 4.

The pre-cooled natural gas is then supplied to a heavy component removing facility 6, in which heavy components are removed. Upon removing heavy components, heavy gases which have two or more carbon atoms (ethane and components which are heavier than ethane), for example, are removed. The removal of heavy component is achieved by separating ethane or heavier components than ethane by fractionation, for example.

The separated heavy gases having two or more carbon atoms are supplied to a fractionating facility 15 which fractionates these heavy gases. Thereafter, light components having four or fewer carbon atoms are collected, supplied to a cryogenic heat exchanger 7, and then mixed with liquefied natural gas. Heavy components with five or more carbon atoms are obtained as a "condensate," which is a product.

The natural gas from which the heavy components (principally, methane, some ethane, propane, and butane) have been removed is supplied to a cryogenic heat exchanger 7, in which the natural gas is refrigerated, condensed and liquefied by means of indirect heat exchange achieved by vaporization of the second refrigerant, and a liquefied natural gas is obtained. A second refrigerant compressor 8 compresses the vaporized second refrigerant which has been used for refrigerating and condensing the feed gas in the cryogenic heat exchanger 7, and supplies it to the cryogenic heat exchanger 7.

Next, layout of each of the facilities employed in the gas liquefaction plant 1 according to this embodiment of the present invention will be described.

The piping complex (pipe rack) 11 for installing piping 10 which is employed in the gas liquefaction plant 1 is extendedly provided, and the first refrigerant compressor 5, the pre-cooling exchanger 4, the heavy component removing facility 6, the cryogenic heat exchanger 7, and the second refrigerant compressor 8 are installed adjacent to each other at one side 16 of the pipe rack. Furthermore, the refrigerant piping 9 which connects the pre-cooling exchanger 4 and the first refrigerant compressor 5, and the refrigerant piping 9 which connects the cryogenic heat exchanger 7, the second refrigerant compressor 8 and the pre-cooling exchanger 4 are arranged at one side 16 of the pipe rack without being installed in the pipe rack 11. The pre-cooling exchanger 4 and the first refrigerant compressor 5 are installed adjacent to each other, and the cryogenic heat exchanger 7 and the second refrigerant compressor 8 are installed adjacent to each other. At the one side 16 of the pipe rack, the heavy component removing facility 6 is installed between a first heat exchange area 12 defined by the pre-cooling exchanger 4 and the first refrigerant compressor 5, and a second heat exchange area 13 defined by the cryogenic heat exchanger 7 and the second refrigerant compressor 8.

In addition, at the other side 17 of the pipe rack, the acid gas removal facility 2 and the dehydrating facility 3, which define a pre-treatment facility 14 which pre-treats the natural gas before cooling the natural gas using the group of pre-cooling exchangers 4, are installed. Furthermore, a fractionating facility 15 which fractionates the heavy gases separated by the heavy component removing facility 6 and collects butane or other components lighter than butane, is installed at the other side 17 of the pipe rack.

It should be noted that the acid gas removal facility 2, the dehydrating facility 3, the pre-cooling exchanger 4, the heavy component removing facility 6, and the cryogenic heat exchanger 7 are connected via the piping 10, defining a product line as a whole.

According to the gas liquefaction plant 1 of one embodiment of the present invention, since the pre-cooling exchanger 4, the first refrigerant compressor 5, the cryogenic heat exchanger 7, and the second refrigerant compressor 8 are installed at one side 16 of the piping complex, it is not required to install the refrigerant piping 9 which connects the pre-cooling exchanger 4 and the first refrigerant compressor 5, and the refrigerant piping 9 which connects the cryogenic heat exchanger 7 and the second refrigerant compressor 8 in the pipe rack 11. Thus, it is possible reduce the height of the pipe rack 11, to solve the issue of the strength of the pipe rack 11, to shorten the design and construction period of the pipe rack 11 so as to reduce the construction cost. In addition, it is possible to reduce high elevation work so that the risk related to the construction is reduced.

In addition, since it is possible to shorten the refrigerant piping 9 which connects the pre-cooling heat exchanger 4 and the first refrigerant compressor 5, and the refrigerant piping 9 which connects the cryogenic heat exchanger 7 and the second refrigerant compressor 8, heat loss and pressure drop of a refrigerant can be reduced.

Furthermore, according to the gas liquefaction plant 1 of one embodiment of the present invention, since the pre-cooling exchanger 4 and the first refrigerant compressor 5 are installed adjacent to each other, and the cryogenic heat exchanger 7 and the second refrigerant compressor 8 are installed adjacent to each other. Thus, since it is possible to shorten the refrigerant piping 9 which connects the pre-cooling heat exchanger 4 and the first refrigerant compressor 5, and the refrigerant piping 9 which connects the cryogenic heat exchanger 7, the second refrigerant compressor 8 and pre-cooling exchanger 4, heat loss and pressure drop of the refrigerant can be reduced.

Furthermore, according to the gas liquefaction plant 1 of one embodiment of the present invention, since the heavy component removing facility 6 is installed between the first heat exchange area 12 and the second heat exchange area 13, the natural gas being supplied to the heavy component removing facility 6, and the natural gas exiting from the heavy component removing facility 6 can be pre-cooled effectively. Moreover, since the pre-treatment facility 14 for pre-treating the natural gas and the fractionating facility 15 which fractionates the heavy gases separated by the heavy components removal machine 6 and collects butane and lighter components than butane before the natural gas, are installed at the other side 17 of the pipe rack, it is possible to prevent various facilities from being installed only at one side of the piping complex. Thus, it is possible to reduce the size of the gas liquefaction plant.

According to the present invention, since the pre-cooling exchanger, the first refrigerant compressor, the cryogenic heat exchanger and the second refrigerant compressor are installed at one side of the piping complex, it is not required to install, in the piping complex, the refrigerant piping which connects the pre-cooling exchanger and the first refrigerant compressor, and the refrigerant piping which connects the cryogenic heat exchanger and the second refrigerant compressor. Thus, it is possible to reduce the height of the piping complex, to solve the issue of the strength of the piping complex, to shorten the design and construction period of the piping complex so as to reduce the construction cost. In addition, it is possible to reduce high elevation work so that the risk related to the construction is reduced.

In addition, since it is possible to shorten the refrigerant piping which connects the first refrigerant compressor to a pre-cooling heat exchanger, and the refrigerant piping which connects the cryogenic heat exchanger and the second refrigerant compressor, heat loss and pressure drop of a refrigerant can be reduced.

While preferred embodiments of the invention have been described and illustrated above, it should be understood that these are examples of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A gas liquefaction plant comprising:

a pre-cooling exchanger which pre-cools a feed gas by means of indirect heat exchange with a first refrigerant;

a first refrigerant compressor which compresses the first refrigerant which has been used for refrigerating the feed gas in the pre-cooling exchanger;

a cryogenic heat exchanger which refrigerates and liquefies the feed gas which has been pre-cooled by the pre-cooling exchanger by means of indirect heat exchange with a second refrigerant;

a second refrigerant compressor which refrigerates the second refrigerant which has been used for cooling and liquefying the feed gas in the cryogenic heat exchanger; and a piping complex which receives piping used in the gas liquefaction plant, wherein the pre-cooling exchanger, the first refrigerant compressor, the cryogenic heat exchanger, and the second refrigerant compressor are installed at one side of the piping complex, and the refrigerant piping which connects the pre-cooling heat exchanger and the first refrigerant compressor, and the refrigerant piping which connects the cryogenic heat exchanger and the second refrigerant compressor are arranged without being installed in the piping complex.

2. The gas liquefaction plant according to claim 1, wherein the pre-cooling exchanger and the first refrigerant compressor are installed adjacent to each other, and the cryogenic heat exchanger and the second refrigerant compressor are installed adjacent to each other.

3. The gas liquefaction plant according to claim 1, wherein a heavy component removing facility which removes a heavy component in the feed gas is installed between a first heat exchange area defined by the pre-cooling exchanger and the first refrigerant compressor, and a second heat exchange area defined by the cryogenic heat exchanger and the second refrigerant compressor at one side of the piping complex, and a pre-treatment facility which pre-treats the feed gas before the feed gas is cooled by the pre-heat exchanger, is installed at the other side of the piping complex.

4. The gas liquefaction plant according to claim 1, further comprising:

a pre-treatment facility for pre-treating the feed gas; and a fractionating facility which fractionates the feed gas; wherein the pre-treatment facility and the fractionating facility are installed at the other side of the piping complex.

* * * * *